US007749947B2

(12) United States Patent
Griffo et al.

(10) Patent No.: US 7,749,947 B2
(45) Date of Patent: Jul. 6, 2010

(54) HIGH PERFORMANCE ROCK BIT GREASE

(75) Inventors: Anthony Griffo, The Woodlands, TX (US); Madapusi K. Keshavan, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 1099 days.

(21) Appl. No.: 11/415,385

(22) Filed: May 1, 2006

(65) Prior Publication Data

US 2007/0254817 A1 Nov. 1, 2007

(51) Int. Cl.
*C10M 125/04* (2006.01)
*C10M 133/20* (2006.01)
*C10M 125/02* (2006.01)

(52) U.S. Cl. ..... 508/150; 508/363; 508/123; 175/331

(58) Field of Classification Search ..... 508/150, 508/363, 123; 175/331
See application file for complete search history.

(56) References Cited

U.S. PATENT DOCUMENTS

| | | | | |
|---|---|---|---|---|
| 3,062,741 | A | 11/1962 | Crowl | |
| 3,107,878 | A | 10/1963 | Wong | |
| 3,281,355 | A | 10/1966 | Cyphers et al. | |
| 3,384,582 | A | 5/1968 | Groszek et al. | |
| 4,358,384 | A | 11/1982 | Newcomb | |
| 4,827,064 | A | 5/1989 | Wu | |
| 5,589,443 | A | 12/1996 | Denton et al. | |
| 5,668,092 | A | 9/1997 | Denton | |
| 6,221,275 | B1 | 4/2001 | Choi et al. | |
| 6,352,961 | B1 * | 3/2002 | Iso et al. | 508/155 |
| 6,447,692 | B1 | 9/2002 | Momoda et al. | |
| 6,689,721 | B2 | 2/2004 | Denpo et al. | |
| 6,789,634 | B1 | 9/2004 | Denton | |
| 6,878,676 | B1 | 4/2005 | Migdal et al. | |
| 7,013,998 | B2 | 3/2006 | Ray et al. | |
| 2003/0024743 | A1 * | 2/2003 | Peterson | 175/371 |
| 2003/0158047 | A1 * | 8/2003 | Denpo et al. | 508/113 |
| 2004/0092408 | A1 | 5/2004 | Willey et al. | |
| 2005/0109502 | A1 | 5/2005 | Buc Slay et al. | |
| 2005/0124504 | A1 | 6/2005 | Zhang et al. | |
| 2005/0133265 | A1 | 6/2005 | Denton et al. | |
| 2008/0242566 | A1 * | 10/2008 | Lockwood et al. | 508/113 |

FOREIGN PATENT DOCUMENTS

| | | |
|---|---|---|
| CN | 1696258 | 11/2005 |
| CN | 1740290 | 3/2006 |
| DE | 10063886 | 6/2002 |
| GB | 2326894 | 1/1999 |
| JP | 2002265968 A * | 9/2002 |

(Continued)

OTHER PUBLICATIONS

Canadian Office Action issued in Application No. 2586832 dated Feb. 12, 2009 (3 pages).

(Continued)

*Primary Examiner*—Glenn Caldarola
*Assistant Examiner*—Jim Goloboy

(57) ABSTRACT

A lubricant for a drill bit that includes from about 0.1 to about 10 weight percent of at least one nanomaterial, from about 5 to 40 weight percent of a thickener, and a basestock is disclosed.

16 Claims, 2 Drawing Sheets

FOREIGN PATENT DOCUMENTS

| | | |
|---|---|---|
| JP | 2004331737 | 11/2004 |
| JP | 2006241443 | 9/2006 |
| KR | 2002-0069271 | 8/2002 |
| WO | 2005026607 | 3/2005 |

OTHER PUBLICATIONS

Combined Search and Examination Report issued in GB Application No. 0822279.6 dated Feb. 19, 2009 (8 pages).

F.D.S. Marquis and L.P.F. Chibante; Improving the heat transfer of Nanofluids and Nanolubricants with Carbon Nanotubes; JOM, Dec. 2005, 32-43.

Ouyang, Q. and K. Okada; Nano-ball bearing effect of ultra-fine particles of cluster diamond; Applied Surface Science 78 (1994) 309-313.

Vereschagin et al.; Properties of ultrafine diamond clusters from detonation synthesis; Diamond and Related Materials, 3 (1993) 160-162.

Combined Search and Examination Report issued in GB Application No. 0708220.9 dated Aug. 21, 2007 (7 pages).

* cited by examiner

HIGH PERFORMANCE ROCK BIT GREASE

BACKGROUND OF INVENTION

1. Field of the Invention

The invention relates generally to a lubricant for lubricating journal bearings in a rock bit for drilling earth formations.

2. Background Art

Rock bits are employed for drilling wells in subterranean formations. Such bits have a body connected to a drill string and a single roller cone or a plurality (typically two or three) of roller cones mounted on the body for drilling rock formations. The roller cones are mounted on journals or pins integral with the bit body at its lower end. In use, the drill string and bit body are rotated in the bore hole, and each cone rotates on its respective journal as the cone contacts the bottom of the bore hole being drilled.

Drill bits are used in hard, often tough formations and, therefore, high pressures and temperatures are encountered. The total useful life of a drill bit is typically on the order of 20 to 200 hours for bits in sizes of about 6 to 28 inch diameter at depths of about 5,000 to 20,000 feet. Useful lifetimes of about 65 to 150 hours are typical. When a drill bit wears out or fails as a bore hole is being drilled, it is necessary to withdraw the drill string to replace the bit which is a very expensive and time consuming process. Prolonging the lives of drill bits minimizes the lost time in "round tripping" the drill string for replacing bits.

Replacement of a drill bit can be required for a number of reasons, including wearing out or breakage of the structure contacting the rock formation. One reason for replacing the rock bits includes failure or wear of the journal bearings on which the roller cones are mounted. The journal bearings are subjected to very high drilling loads, high hydrostatic pressures in the hole being drilled, and high temperatures due to drilling, as well as elevated temperatures in the formation being drilled. The operating temperature of the grease in the drill bit can exceed 300° F. Considerable work has been conducted over the years to produce bearing structures and employ lubricants between the bearing surfaces that reduce friction, minimize wear and failure of such bearings.

A variety of grease compositions have been previously employed in attempts to reduce friction and thus reduce wear. U.S. Pat. No. 4,358,384 discloses one prior art grease composition that consists of a petroleum derived mineral oil lubricant basestock and a metal soap or metal complex soap including aluminum, barium, calcium, lithium, sodium or strontium metals. A lighter, lower-viscosity basestock is generally employed to obtain low temperature greases, and a heavier, higher-viscosity basestock is used to obtain high temperature greases.

Without being restricted to any method, in drilling applications, the mechanism of lubrication is by way of hydrodynamic lubrication. When at rest, the journal and the journal bearings of a drill bit squeeze out the lubricant and make direct contact. As the journal begins to rotate, the lubricant is drawn into the space between contacting surfaces to form a fluid wedge there between. As the journal rotation increases speed, this fluid wedge pushes the journal off the bearings and forms a lubricating film between the contacting surfaces. The film thickness is determined by both the rotation speed and load capacity of the lubricant. If a film is too thin, the asperities may make contact with a greater force, resulting in shearing action between the surfaces instead of a sliding action, which in turn generates heat and wears down the contacting surfaces.

In order to enhance the lubricating capacity of typical petroleum basestock greases, anti-wear agents have been typically added. The anti-wear agents, many of which function by a process of interactions with the metal surfaces, provide a chemical film which reduces or prevents metal-to-metal contact under high load conditions. U.S. Pat. Nos. 4,358,384, 3,062,741, 3,107,878, 3,281,355, and 3,384,582 disclose the use of molybdenum disulfide, and other solid additives such as copper, lead and graphite, which have been employed to attempt to enhance the lubrication properties of oils and greases.

Additives which are useful under extremely high load conditions are frequently called extreme pressure (EP) agents. These materials serve to enhance the ability of the lubricant base stock to form a friction-reducing film between the moving metal surfaces under conditions of extreme pressure and to increase the load carrying capacity of the lubricants. The function of the lubricant is to minimize wear and to prevent scuffing and welding between contacting surfaces. When metal asperities make contact with greater force and result in shearing rather than sliding, which in turn generates heat and wears down the contacting surfaces, EP additives in the lubricant are activated by the high temperature resulting from the extreme pressure to react with the exposed metal surfaces and form a protective coating thereon.

Additionally, while the basestock grease serves important functions with respect to friction and wear performance, it is generally inferior with respect to thermal conductivity. The thermal conductivity of oils, e.g., mineral oil, polyalphaolefins, ester synthetic oils, etc is typically in the range of 0.12 to 0.16 W/m*K, and water has a much higher thermal conductivity at 0.61 W/m*K. Many of the additives present in a lubricating composition may also act to improve the cooling capabilities as compared to a basestock alone. It is well known that metals in solid form have orders-in-magnitude larger thermal conductivities than those of fluids. For example, the thermal conductivity of copper at room temperature is about 3000 times greater than engine oil or pump oil. Therefore, typical lubricants containing such metallic particles generally exhibit significantly enhanced thermal conductivities relative to fluids alone.

Efforts to even further improve the thermal capacity of heat transfer fluids (coolants) have been attempted by varying the metallic additives, not just in type, but in size as well. The original studies of the thermal conductivity of suspensions were confined to those containing millimeter- or micron-sized particles. Maxwell's model shows that the effective thermal conductivity of suspensions containing spherical particles increases with the volume fraction of the solid particles. It is also known that the thermal conductivity of suspensions increases with the ratio of the surface area to volume of the particle. Using Hamilton and Crosser's model, it can be calculated that, for constant particle size, the thermal conductivity of a suspension containing large particles is more than doubled by decreasing the sphericity of the particles from a value of 1.0 to 0.3 (the sphericity is defined as the ratio of the surface area of a particle with a perfectly spherical shape to that of a non-spherical particle with the same volume). Because the surface area to volume ratio is 1000 times larger for particles with a 10 nm diameter than for particles with a 10 μm diameter, a much more dramatic improvement in effective thermal conductivity can be expected as a result of decreasing the particle size in a solution than can obtained by altering the particle shapes of large particles. While nanoparticles have been introduced in typical coolants, in the drilling industry the only nanoparticles used have been limited to carbon black, which shows a fairly low increase in thermal conductivity.

For additives to prove beneficial in a grease used in a drilling application, it is necessary to balance thermal performance, the load carrying capacity, and seal/glad wear. Generally, lubricants that reduce seal and gland wear typically lack sufficient film strength, that is, load carrying capacity, and lubricants with sufficient film strength tend show excessive seal and glad wear, to be used as a drill bit lubricant.

Accordingly, there exists a need for lubricant that exhibits improved thermal performance, a tight seal, and good load carrying capacity with reduced seal and gland wear.

SUMMARY OF INVENTION

In one aspect, the present invention relates to a lubricant for a drill bit that includes from about 0.1 to about 10 weight percent of at least one nanomaterial, from about 5 to 40 weight percent of a thickener, and a basestock.

In another aspect, the present invention relates to a roller cone drill bit that includes a bit body, at least one leg extending downward from the bit body, wherein each leg has a journal and each journal has a bearing surface, a roller cone mounted on each journal, wherein each roller cone has a bearing surface, a grease reservoir in communication with the bearing surfaces; and a lubricating composition in the grease reservoir and adjacent the bearing surfaces, wherein the lubricating composition includes from about 0.1 to about 10 weight percent of at least one nanomaterial, from about 5 to 40 weight percent of a thickener; and a basestock.

In yet another aspect, the present invention relates to a method for lubricating a roller cone drill bit that includes providing a roller cone drill bit having a bit body, a grease reservoir, and at least one roller cone mounted on the bit body with at least one rotatable journal bearing; and filling the grease reservoir with a lubricant, wherein the lubricant includes from about 0.1 to about 10 weight percent of at least one nanomaterial, from about 5 to 40 weight percent of a thickener, and a basestock.

Other aspects and advantages of the invention will be apparent from the following description and the appended claims.

DETAILED DESCRIPTION

Figure 1:
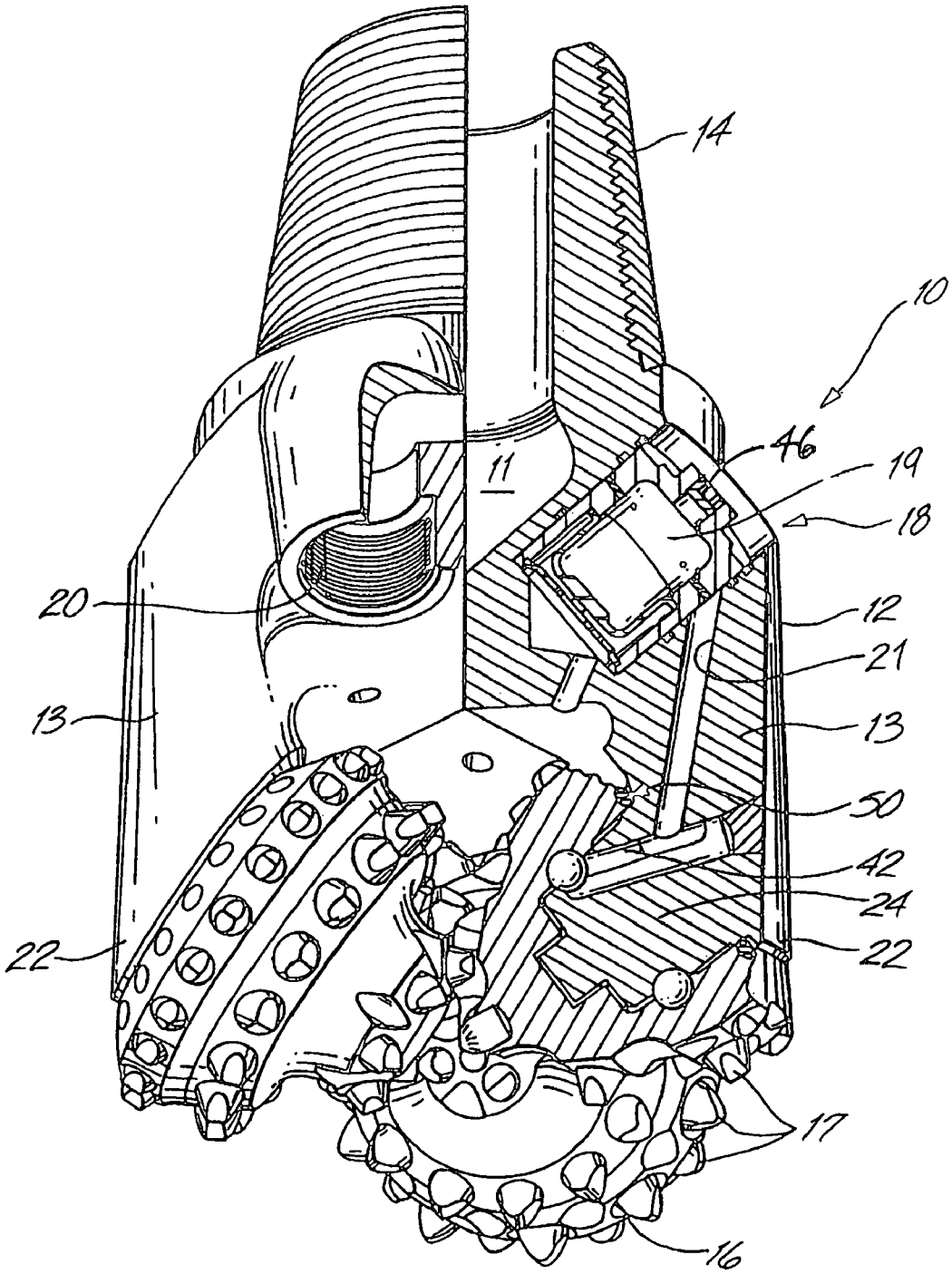
FIG. 1 is a semi-schematic perspective of a rock bit lubricated with a lubricant according to the present invention.

In one aspect, embodiments of the invention relate to lubricants for high temperature applications. As used herein, the term "high temperature" means that the lubricant will spend at least some time in an environment exceeding 250° F. (121° C.). In particular, embodiments of the invention relate to lubricants for drill bits, methods for lubricating, and methods for drilling. In various embodiments, lubricants disclosed herein may comprise a basestock, a thickener, and at least one nanomaterial.

Basestocks:

The basestock, or base oil, form the main lubricating component. Oils are generally classified as refined and synthetic. Refined oils are also referred to as mineral oils or petroleum oils. For example, paraphinic and naphthenic are refined from crude oil while synthetic oils are manufactured by chemical synthesis. The basestock may be selected from any of the basestocks known in the art, including a synthetic base oil, a petroleum or mineral oil, or combinations thereof. In some embodiments, a synthetic lubricant basestock may be preferred over a petroleum derived basestock to increase viscosity. In other embodiments, a high viscosity petroleum derived mineral oil basestock may be used.

Suitable synthetic oils for use in a basestock may include synthetic polyalphaolefins, other hydrocarbon fluids and oils, synthetic polyethers, poly-esters, alkylene oxide polymers, and interpolymers, esters of phosphorus containing acids, silicon based oils and mixtures thereof. In one embodiment, the basestock may include a high viscosity index polyalphaolefin based fluid. Suitable polyalphaolefins include those discussed in U.S. Pat. Nos. 5,589,443, 5,668,092, and 4,827,064, which are incorporated herein by reference in their entirety. Other suitable synthetic oils include alkylated naphthalenes, such as Synesstic™ AN, which is available from ExxonMobil Corporation (Fairfax, Va.), polybutenes, such as Indopol™ polybutenes which are available from BP P.L.C. (Warrenville, Ill.), and hydrogenated polybutenes, such as Panalane™ hydrogenated polybutenes, which are available from BP P.L.C. (Warrenville, Ill.).

Suitable mineral or petroleum oils may include naphthenic or paraffinic oil. Other suitable mineral oils may include high viscosity index hydroprocessed basestock and bio-based esters.

In one embodiment, the basestock may be a blend of mineral oil and synthetic oil. Specifically, in one embodiment, the basestock may be a blend of 0 to 100% mineral oil and 100 to 0% synthetic oil with any percentage therebetween, preferably about 50% of each.

Thickeners

Thickeners give a lubricant its characteristic consistency and are sometimes thought of as a "three-dimensional fibrous network" or "sponge" that holds the oil in place.

In one embodiment, the base oil may be thickened with a soap, such as soaps of calcium, aluminum, titanium, barium, lithium, and their complexes. Metal complex soaps may include alkali metals, alkaline earth metals, Group IVB metals, and aluminum. Simple soaps may be formed by combining a fatty acid or ester with a metal and reacting through a saponification process, with the application of heat, pressure, or agitation. While simple soaps are formed by reacting one single organic acid with a metal hydroxide, complex soaps may be formed by reacting two or more organic compounds with the metal hydroxide.

In another embodiment, the base oil may be thickened with a non-soap, such as urea, fine silica, fine clay, and/or silica gel. In yet another embodiment, the basestock may be thickened with both soap and non-soap thickening agents. While the above description lists several specific thickening agents, no limitation is intended on the scope of the invention by such a description. It is specifically within the scope of the present invention that other soap and non-soap thickening agents may be used.

Additives:

Additives that are commonly added to lubricants to improve their performances may also be added to a lubricant of the present invention. For example, a grease may typically include various additives, such as, additives for lubricity, extreme pressure (EP), antiwear, corrosion, solubility, anti-seize protection, oxidation protection and the like. One of ordinary skill in the art would recognize that various types additives may also serve multiple roles, such as, for example, an antiwear additive also serving as an extreme pressure additive or antioxidant. Additionally, many of the extreme pressure additives, antiwear additives, lubricious solids aid serve to improve the load carrying capacity of a lubricant.

When employed, such additives are typically present in lubricant formulation in amounts ranging from about 1 to about 20 weight percent.

Lubricious solids that may be incorporated in the lubricants disclosed herein may include, for example, molybdenum disulfide, graphite, polarized graphite, carbon black, metals, such as lead, copper, and silver, metal oxide particles, such as lead oxide, zinc oxide, aluminum oxide, copper oxide, bismuth oxide, and antimony trioxide, carbon nanostructures, and diamond particles. In one embodiment, the at least one nanomaterial may include at least one lubricious solid. Nanomaterial lubricious solids may be added to lubricants disclosed herein in an amount greater than about 0.1, 0.2, 0.3, and 0.5 weight percent in some embodiments, and less than 10, 5, 2, and 1 weight percent in other embodiments.

Antiwear additives that may be used in the lubricants disclosed herein include for example, a metal phosphate, a metal dialkyldithiophosphate, a metal dithiophosphate, a metal thiocarbamate, a metal dithiocarbamate, an ethoxylated amine dialkyldithiophosphate and an ethoxylated amine dithiobenzoatees. Metal thiocarbamates may include lead diamyldithiocarbamate, molybdenum di-n-butyldithiocarbamate, molybdenum dialkyldithiocarbamate, zinc diamyldithiocarbamate, zinc dithiocarbamate, antimony dithiocarbamate. In one embodiment, the at least one nanomaterial may include at least one antiwear additive. Nanoscale antiwear additives may be added to lubricants disclosed herein in an amount greater than about 0.1, 0.2, 0.3, and 0.5 weight percent in some embodiments, and less than 10, 5, 2, and 1 weight percent in other embodiments.

Extreme pressure agents that may be used in the lubricants disclosed herein include for example, bismuth oxide, bismuth hydroxide, and molybdenum disulfide, bismuth ethylhexanoate, non-metallic sulfur containing compounds such as a substituted 1,3,4-thiadiazole, non-metallic chloride-sulfur-phosphorus compounds, molybdenum di(2-ethylhexyl) phosphorodithioate, molybdenum di-2-ethylhexyl dithiophosphate, bismuth dithiocarbamates, hexagonal boron nitride (hBN), zinc- and chlorine-based EP agents, such as Lubrizol™ 885 and Lubrizol™ 2501, which are both commercially available from The Lubrizol Corporation (Wickliffe, Ohio). A single EP additive may be employed, or alternatively, a combination of two or more EP agents may be employed. In one embodiment, the at least one nanomaterial may include at least one extreme pressure additive. Nanoscale extreme pressure additives may be added to lubricants disclosed herein in an amount greater than about 0.1, 0.2, 0.3, and 0.5 weight percent in some embodiments, and less than 10, 5, 2, and 1 weight percent in other embodiments.

In addition to those additives described above, additives that may also find use in improving the load carrying capacity of the lubricants disclosed herein include metals and borates, such as, for example, tungsten disulfide, boron nitride, monoaluminum phosphate, tantalum sulfide, iron telluride, zinconium sulfide, zinc sulfide, zinconium nitride, zirconium chloride, bismuth sulfate, chromium boride, chromium chloride, sodium tetraborate, tripotassium borate, zirconium naphthenate, zirconium 2-ethylhexanoate, zirconium 3,5-dimethyl hexanoate, and zirconium neodecanoate. In one embodiment, the at least one nanomaterial may comprise at least one of a metal, metal oxide, metal boride, and metal borate. Nanomaterial metals and/or borates may be added to lubricants disclosed herein in an amount greater than about 0.1, 0.2, 0.3, and 0.5 weight percent in some embodiments, and less than 10, 5, 2, and 1 weight percent in other embodiments.

Additionally, for a review of common lubricant additives, see *Lubricant Additives: Chemistry and Applications*, edited by Leslie R. Rudnick (2003, ISBN 0824708571). Some of these additives include metal deactivators, solubility aids, antioxidants, viscosifiers, etc. Metal deactivators that may be incorporated in the lubricants disclosed herein to act to protect against nonferrous corrosion may include, for example, benzotriazole, and its derivatives. Metal deactivators acting against ferrous corrosion may include, for example, alkylated organic acid and esters, organic acids, phenates, and sulfonates. Common solubility aids, which solubilize the additives into the oil or soap, may include, for example esters, such as polyol esters, monoesters, diesters, and trimellitate esters. Antioxidants used in grease formulations may include, for example, substituted diphenylamines, amine phosphates, aromatic amines, butylated hydroxytoluene, phenolic compounds, zinc dialkyl dithiophosphates, and phenothiazine. When a grease is utilized to lubricate a rock bit, it is generally preferred not to employ a zinc dialkyl dithiophosphate antioxidant if the rock bit comprises an incompatible metal, e.g., silver. In other lubricating applications, however, zinc dialkyl dithiophosphates may be employed as antioxidants. Additives that can be utilized in grease formulations for tackiness include polybutenes. In addition, viscosity index improvers, which help to extend the operating range of the grease, may be used. Typical viscosity index improvers include polybutene and polyisobutylene polymers. Silicones or polymers can also be incorporated as antifoam agents and/or air entrainment aids. A variety of dyes can also be used to impart color to the grease. In addition, odor maskers such as pine oil can also be employed. Additionally, if the composition of the basestock is predominantly synthetic oil, an ester-based swelling agent may also be added to enhance the wetting and suspension of silica. One suitable swelling agent includes Esterex C4461, which is available from ExxonMobil Corporation (Fairfax, Va.).

Exemplary Formulations

In one embodiment of the present invention, the lubricant may include at least one nanomaterial. Nanomaterial that may incorporated into the lubricants disclosed herein may include any solid additives among those described above. In a particular embodiment, nanomaterials that may be incorporated into the lubricants disclosed herein may include any additive that functions to improve the load carrying capacity of the lubricant. As used herein, the term nanomaterial refers to materials having a major dimension of less than 1000 nanometers. For spherical particles, the major dimension is the diameter of the sphere; for non-spherical particles, the major dimension is the longest dimension.

In a particular embodiment, the nanomaterial may a scale ranging from about 0.1 to 100 nanometers. In another embodiment, the nanomaterial may have a scale ranging from 0.5 to 50 nanometers. In yet another embodiment, the nanomaterial may have a scale ranging from about 1.0 to 10 nanometers. In another embodiment, the nanomaterial may have an aspect ratio ranging from 1.0 to 300. In yet another embodiment, the nanomaterial may have an aspect ratio ranging from 3.0 to 100.

In particular embodiments, the at least one nanomaterial may include metal particles selected from at least one of lead, copper, silver, and aluminum. Metal particles may be added to lubricants disclosed herein in an amount greater than about 0.1, 0.2, 0.3, and 0.5 weight percent in some embodiments, and less than 10, 5, 2, and 1 weight percent in other embodiments.

In other embodiment, the at least one nanomaterial may include metal oxide particles selected from at least one of lead oxide, zinc oxide, antimony trioxide, aluminum oxide, bismuth oxide, copper oxide. Metal oxide particles may be added to lubricants disclosed herein in an amount greater than about 0.1, 0.2, 0.3, and 0.5 weight percent in some embodiments, and less than 10, 5, and 2 weight percent in other embodiments.

In one embodiment, the at least one nanomaterial may include molybdenum disulfide or other derivates thereof. Molybdenum sulfide particles may be added to the lubricants disclosed herein in an amount greater than about 0.1, 0.2, 0.3, and 0.5 weight percent in some embodiments, and less than 10, 5, 2, and 1 weight percent in other embodiments.

In other embodiments, the at least one nanomaterial may include carbon nanostructures. Carbon nanostructures may include, for example, single wall carbon nanotubes, multiwall carbon nanotubes, and vapor grown carbon fibers. Optionally, carbon nanotubes may be functionally treated to alter the properties of the nanotube. In one embodiment, the lubricant may include a treated nanotube and at least one other nanomaterial. Carbon nanostructures may be added to lubricants disclosed herein in an amount greater than about 0.1, 0.2, 0.5 weight percent in some embodiments, and less than 10, 5, 2, and 1 weight percent in other embodiments.

In a particular embodiment, the at least one nanomaterial may include polarized graphite. Polarized graphite is described is U.S. Patent Publication No. 2005/0133265, which is incorporated by reference herein. Briefly, polarized graphite may be formed by treating graphite with alkali molybdates and/or tungstenates, alkali earth sulfates and/or phosphates and mixtures thereof to impart a polarized layer at the surface of the graphite. Polarized graphite is available from Dow Corning Corporation, Midland, Mich., under the tradename Lubolid®. The lubricants disclosed herein may include polarized graphite in an amount greater than about 0.1, 0.2, 0.3, and 0.5 weight percent in some embodiments, and less than 10, 5, 2, and 1 weight percent in other embodiments.

In particular embodiments, the at least one nanomaterial may include diamond particles or diamond-like particles. One suitable method for generating nanodiamond may include, for example, a detonation process as described in *Diamond and Related Materials* (1993, 160-2), which is incorporated by reference in its entirety, although nanodiamond produced by other methods may be used. Those having ordinary skill in the art will appreciate how to form nanodiamond particles. Briefly, in order to produce nanodiamond by detonation, detonation of mixed high explosives in the presence of ultradispersed carbon condensate forms ultradispersive diamond-graphite powder (diamond blend or DB), which is a black powder containing 40-60 weight percent of pure diamond. Chemical purification of DB generates pure nanodiamond (ultradispersive detonational diamond or UDD), a grey powder containing up to 99.5 weight percent of pure diamond. The ultrafine diamond particles generated by the detonation process may comprise a nanodiamond core, a graphite inner coating around the core, and an amorphous carbon outer coating about the graphite. Both the graphite coating and amorphous carbon coating may be optionally removed by chemical etching. In some embodiments, the nanodiamond particles may be clustered in loose agglomerates ranging in size from nanoscale to larger than nanoscale. Diamond or diamond-like particles may be added to lubricants disclosed herein in an amount greater than about 0.1, 0.2, 0.5 weight percent in some embodiments, and less than 10, 5, 2, and 1 weight percent in other embodiments.

In yet another embodiment, the at least one nanomaterial may include hBN particles. HBN particles may be added to lubricants disclosed herein in an amount greater than about 0.1, 0.2, 0.5 weight percent in some embodiments, and less than 10, 5, 2, and 1 weight percent in other embodiments.

In one embodiment, a lubricant may include from about 0.1 to about 10 weight percent nanomaterial selected from at least one of lead, copper, silver, aluminum, lead oxide, zinc oxide, antimony trioxide, aluminum oxide, copper oxide, bismuth oxide, molybdenum disulfide, carbon nanostructures, polarized graphite, diamond, and hBN; about 1 to about 10 weight percent of silica; about 5 to about 40 weight percent of a thickening agent, preferably a metal-complex soap, and a balance of a heavy mineral basestock. In another embodiment, the lubricant may further comprise at least one additional additive.

Figure 2:
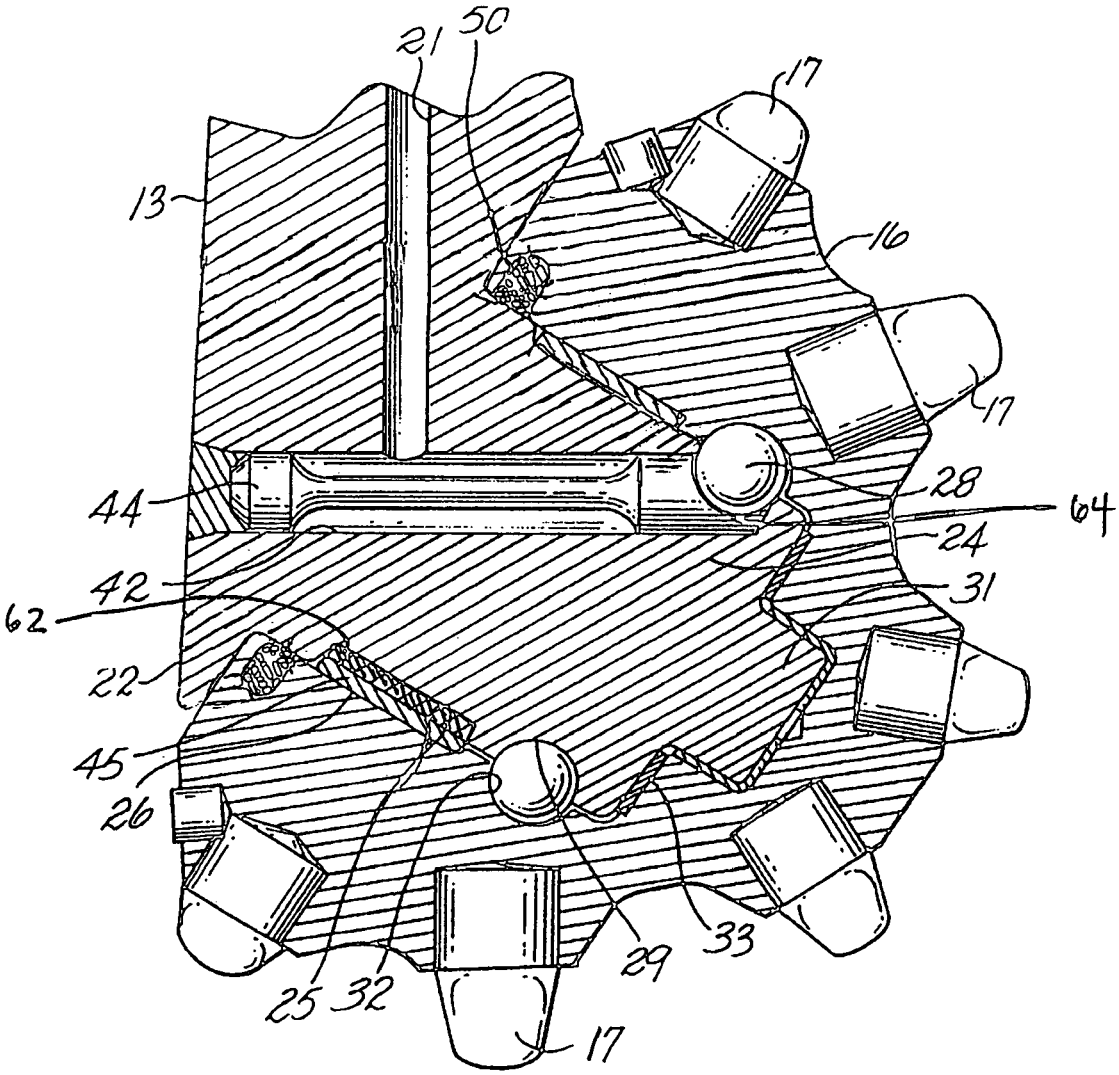
FIG. 2 is a partial cross-section of the drill bit in FIG. 1.

Application of the Lubricant in a Drill Bit:

Referring now FIGS. 1 and 2, a sealed bearing rotary cone rock bit, generally designated as 10, consists of bit body 12 forming an upper pin end 14 and a cutter end of roller cones 16 that are supported by legs 13 extending from body 12. The threaded pin end 14 is adapted for assembly onto a drill string (not shown) for drilling oil wells or the like. Each of the legs 13 terminate in a shirttail portion 22. Each of the roller cones 16 typically have a plurality of cutting elements 17 pressed within holes formed in the surfaces of the cones for bearing on the rock formation to be drilled. Nozzles 20 in the bit body 12 introduce drilling mud into the space around the roller cones 16 for cooling and carrying away formation chips drilled by the drill bit. While reference is made to an insert-type bit, the scope of the present invention should not be limited by any particular cutting structure. Embodiments of the present invention generally apply to any rock bit (whether roller cone, disc, etc.) that requires lubrication by grease.

Each roller cone 16 is in the form of a hollow, frustoconical steel body having cutting elements 17 pressed into holes on the external surface. For long life, the cutting elements may be tungsten carbide inserts tipped with a polycrystalline diamond layer. Such tungsten carbide inserts provide the drilling action by engaging a subterranean rock formation as the rock bit is rotated. Some types of bits have hardfaced steel teeth milled on the outside of the cone instead of carbide inserts.

Each leg 13 includes a journal 24 extending downwardly and radially inward on the rock bit body. The journal 24 includes a cylindrical bearing surface 25 which may have a flush hardmetal deposit 62 on a lower potion of the journal 24.

The cavity in the cone 16 contains a cylindrical bearing surface 26. A floating bearing 45 may be disposed between the cone and the journal. Alternatively, the cone may include a bearing deposit in a groove in the cone (not shown separately). The floating bearing 45 engages the hardmetal deposit 62 on the leg and provides the main bearing surface for the cone on the bit body. The end surface 33 of the journal 24 carries the principal thrust loads of the cone 16 on the journal 24. Other types of bits, particularly for higher rotational speed applications, may have roller bearings instead of the exemplary journal bearings illustrated herein.

A plurality of bearing balls 28 are fitted into complementary ball races 29, 32 in the cone 16 and on the journal 24. These balls 28 are inserted through a ball passage 42, which extends through the journal 24 between the bearing races and the exterior of the drill bit. A cone 16 is first fitted on the journal 24, and then the bearing balls 28 are inserted through the ball passage 42. The balls 28 carry any thrust loads tending to remove the cone 16 from the journal 24 and thereby retain the cone 16 on the journal 24. The balls 28 are retained in the races by a ball retainer 64 inserted through the ball passage 42 after the balls are in place. A plug 44 is then welded into the end of the ball passage 42 to keep the ball retainer 64 in place.

Contained within bit body 12 is a grease reservoir system generally designated as 18. Lubricant passages 21 and 42 are provided from the reservoir to bearing surfaces 25, 26 formed between a journal bearing 24 and each of the cones 16. Drilling fluid is directed within the hollow pin end 14 of the bit 10 to an interior plenum chamber 11 formed by the bit body 12. The fluid is then directed out of the bit through the one or more nozzles 20.

The bearing surfaces between the journal 24 and cone 16 are lubricated by a lubricant or grease composition. Preferably, the interior of the drill bit is evacuated, and lubricant or grease is introduced through a fill passage 46. The lubricant or grease thus fills the regions adjacent the bearing surfaces plus various passages and a grease reservoir. The grease reservoir comprises a chamber 19 in the bit body 10, which is connected to the ball passage 42 by a lubricant passage 21. Lubricant or grease also fills the portion of the ball passage 42 adjacent the ball retainer. Lubricant or grease is retained in the bearing structure by a resilient seal 50 between the cone 16 and journal 24.

Lubricant contained within chamber 19 of the reservoir is directed through lube passage 21 formed within leg 13. A smaller concentric spindle or pilot bearing 31 extends from end 33 of the journal bearing 24 and is retained within a complimentary bearing formed within the cone. A seal generally designated as 50 is positioned within a seal gland formed between the journal 24 and the cone 16.

In one embodiment, the lubricant or grease in the grease reservoir may include from about 0.1 to about 10 weight percent of a nanomaterial selected from at least one of lead, copper, silver, aluminum, lead oxide, zinc oxide, antimony trioxide, aluminum oxide, copper oxide, bismuth oxide, molybdenum disulfide, carbon nanostructures, polarized graphite, diamond, and hBN; about 1 to about 10 weight percent of silica; about 5 to about 40 weight percent of a thickening agent, preferably a metal-complex soap, and a balance of a basestock. In another embodiment, the lubricant may further comprise at least one additional additive. In yet another embodiment, the basestock may be a blend of 0 to 100% mineral oil and 100 to 0% synthetic oil with any percentage therebetween, preferably about 50% of each.

Use of the Lubricant in a Method of Drilling:

According to one aspect of the present invention, a method for drilling is provided. In one embodiment, the method for drilling includes the steps of providing a roller cone drill bit having a bit body and a plurality of roller cones mount on the bit body with rotatable journal bearings, introducing a lubricating composition to the journal bearings, where the lubricating composition includes a basestock, a thickener, and at least one nanomaterial. In one embodiment, the lubricant in the grease reservoir may include from about 0.1 to about 10 weight percent of a nanomaterial selected at least one of lead, copper, silver, aluminum, lead oxide, zinc oxide, antimony trioxide, aluminum oxide, copper oxide, bismuth oxide, molybdenum disulfide, carbon nanostructures, polarized graphite, diamond, and hBN; about 1 to about 10 weight percent of silica; about 5 to about 40 weight percent of a thickening agent, preferably a metal-complex soap, and a balance of a basestock. In another embodiment, the lubricant may further comprise at least one additional additive. In yet another embodiment, the basestock may be a blend of 0 to 100% mineral oil and 100 to 0% synthetic oil with any percentage therebetween, preferably about 50% of each.

A vast number and variety of rock bits can be satisfactorily lubricated with grease compositions of preferred embodiments. The greases of preferred embodiments may also comprise a variety of additives not specifically mentioned above. For example, the grease can contain types of extreme pressure agents, corrosion inhibitors, oxidation inhibitors, anti-wear additives, pour point depressants, and thickening agents not enumerated above. In addition, the grease composition can comprise additives not specifically mentioned such as water repellants, anti-foam agents, color stabilizers, and the like. Also, while the greases of preferred embodiments can be particularly well suited for rock bit lubrication, they can also be suitable for use in other applications, such as bearing lubrication, for example, automotive bearing lubrication (e.g., lubrication of belt tensioner bearings, bearings for fan belts, water pumps, and other under-the-hood engine components), other high temperature and/or high speed bearing lubrication applications, and the like. The greases of preferred embodiments are suitable for use as multipurpose greases in many high temperature applications.

Advantageously, embodiments of the present invention may include one or more of the following. The incorporation of nanomaterials may improve thermal performance including thermal breakdown and conductivity. Increases in the load bearing capacity may also be achieved which may also lead to increases in rate of penetration and the life of the bearing. Various additives may also add corrosion resistance to a metal surface to which the lubricant may be applied. The lubricants may also aid in reducing the hub wear and improve seal appearance with low leakage rates. The range of applicability for the nanomaterials disclosed herein may also allow them to be used with a variety of existing grease compositions to improve lubrication properties and broaden the applicable uses of the greases to otherwise non-applicable uses, such as drilling.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A roller cone drill bit, comprising:

a bit body;

at least one leg extending downward from the bit body, wherein each leg has a journal and each journal has a bearing surface;

a roller cone mounted on each journal, wherein each roller cone has a bearing surface;

a grease reservoir in communication with the bearing surfaces; and a lubricating composition in the grease reservoir and adjacent the bearing surfaces, the lubricating composition comprising:

from about 0.1 to about 10 weight percent of a nanomaterial selected from the group consisting of lead, copper, silver, and combinations thereof;

from about 5 to 40 weight percent of a thickener; and a basestock.

2. The drill bit of claim 1, wherein the basestock comprises from 0 to 100 percent mineral oil and 100 to 0 percent synthetic oil, or any percentage therebetween.

3. The drill bit of claim 1, wherein the lubricating composition further comprises diamond particles comprising a diamond core, an inner coating of graphite and an outer coating of amorphous carbon prepared by a detonation process.

4. The drill bit of claim 1, wherein the lubricating composition further comprises carbon nanotubes.

5. The drill bit of claim 1, wherein the nanomaterial is copper particles.

6. A method for lubricating a roller cone drill bit, comprising:

providing a roller cone drill bit having a bit body, a grease reservoir, and at least one roller cone mounted on the bit body with at least one rotatable journal bearing; and filling the grease reservoir with a lubricant, the lubricant comprising:

from about 0.1 to about 10 weight percent of a nanomaterial selected from the group consisting of lead, copper, silver, and combinations thereof;

from about 5 to 40 weight percent of a thickener; and a basestock.

7. The method of claim 6, wherein the basestock comprises from 0 to 100 percent mineral oil and 100 to 0 percent synthetic oil, or any percentage therebetween.

8. The method of claim 6, wherein the nanomaterial is silver particles.

9. The method of claim 6, wherein the lubricant further comprises diamond particles comprising a diamond core, an inner coating of graphite and an outer coating of amorphous carbon prepared by a detonation process.

10. The method of claim 6, wherein the lubricant further comprises carbon nanotubes.

11. The method of claim 6, wherein the nanomaterial is copper particles.

12. The drill bit of claim 1, wherein the nanomaterial has a size ranging from about 0.1 to 100 nm.

13. The drill bit of claim 1, wherein the nanomaterial has a size ranging from about 1.0 to 10 nm.

14. The drill bit of claim 1, wherein the nanomaterial is silver particles.

15. The drill bit of claim 6, wherein the nanomaterial has a size ranging from about 0.1 to 100 nm.

16. The drill bit of claim 6, wherein the nanomaterial has a size ranging from about 1.0 to 10 nm.

* * * * *